US008882287B2

(12) United States Patent
Taylor

(10) Patent No.: US 8,882,287 B2
(45) Date of Patent: Nov. 11, 2014

(54) RECREATIONAL OR OCCUPATIONAL HEADLAMP USING MODULATED LIGHT COROLLARY TO HUMAN PERSISTENCE OF VISION FOR OPTIMIZED PATH ILLUMINATION

(71) Applicant: Dale Taylor, Centennial, CO (US)

(72) Inventor: Dale Taylor, Centennial, CO (US)

( * ) Notice: Subject to any disclaimer, the term of this patent is extended or adjusted under 35 U.S.C. 154(b) by 124 days.

(21) Appl. No.: 13/628,031

(22) Filed: Sep. 26, 2012

(65) Prior Publication Data

US 2014/0085872 A1 Mar. 27, 2014

(51) Int. Cl.

| | |
|---|---|
| ***F21V 21/084*** | (2006.01) |
| ***F21V 33/00*** | (2006.01) |
| ***F21L 4/00*** | (2006.01) |
| *F21V 21/08* | (2006.01) |

(52) U.S. Cl.

CPC ..... *F21V 33/0008* (2013.01); *F21L 4/00* (2013.01); *F21V 21/084* (2013.01); *F21V 21/0816* (2013.01)

USPC ..... 362/106; 362/105; 362/373

(58) Field of Classification Search

USPC ..... 362/106, 105, 373

See application file for complete search history.

(56) References Cited

U.S. PATENT DOCUMENTS

| | | | | |
|---|---|---|---|---|
| 6,955,444 | B2 * | 10/2005 | Gupta | 362/105 |
| 7,465,078 | B2 * | 12/2008 | Chang | 362/373 |
| 7,883,534 | B1 * | 2/2011 | Crosby | 607/88 |
| 7,905,620 | B2 * | 3/2011 | Harris | 362/105 |
| 8,444,289 | B2 * | 5/2013 | Popper et al. | 362/191 |

* cited by examiner

*Primary Examiner* — Mary Ellen Bowman

(57) ABSTRACT

The invention relates to a novel recreational or occupational modulating light headlamp which works in conjunction with the mechanics of human vision to provide effective path lighting in very low light or dark. Applying flicker fusion rate and factoring in the acuity of the eye's rods and cones, lighting is applied to the range and capability of the ocular abilities and optimized for low light or dark.

5 Claims, 5 Drawing Sheets

RECREATIONAL OR OCCUPATIONAL HEADLAMP USING MODULATED LIGHT COROLLARY TO HUMAN PERSISTENCE OF VISION FOR OPTIMIZED PATH ILLUMINATION

FIELD

The invention relates to a novel source of illumination wherein LED arrays are used in conjunction with human persistence of vision (POV) and peripheral vision characteristics to optimize illumination in the dark or very low light while conserving power consumption.

BACKGROUND OF THE INVENTION

The invention most closely corresponds with USPTO Class 362 which addresses illumination in general, and subclass 37 relating to handheld or body attached lighting.

In its simplest form, the invention comprises a novel utilization of illumination combining LED light with the functionality of the human eye. The preferred embodiment resides in a headlamp mechanism for illuminating a path in low light or dark wherein a person wears the headlamp strapped to their head or a hat and a path will be illuminated based upon functionality of the human eye as relates to "night vision", and its ability to process modulated light.

The human eye sees light differently based upon the part of the eye utilized for the particular light sensitivity. When light travels through water or a lens, its path is bent or refracted. Certain eye structures have refractive properties similar to water or lenses and can bend light rays into a precise point of focus essential for sharp vision. Most refraction in the eye occurs when light rays travel through the cornea. The light is then filtered through the pupil. Thus, the amount of light directed at the center of the eye will directly impact the clarity with which objects are viewed. In the dark, the pupil widens and allows a greater amount of light into the eye, and obviously the signal to the brain will be impacted based upon this data.

THE INVENTION

Summary, Objects And Advantages

The back of the eye, or retina, consists of specialized cells called cones and rods that change light energy into neural signals. Rods and cones interpret different degrees of light. Rods interpret light at night and in dim settings. Cones interpret sunlight and bright lights. There are three different pigments of both rods and cones, one for each of the primary colors. Depending on the frequency of the light, each of these pigments absorbs a different degree of the energy and converts it into neural signals.

The human eye's central vision is typically weaker at night. Peripheral vision is particularly effective in detecting motion. Thus, the two vision types are utilized in concurrence in the inventive headlamp to enable one to see effectively in low light or dark. Center or foveal vision requires ocular adjustment which does not occur as quickly as direct peripheral vision adjustment. With an effective array at varying hertz levels, the inventive headlamp provides light at an optimum gradient in the center and at the sides. Traditional flashlights or lamps may utilize LED lighting, but none in the art are optimized to work directly with the mechanics of human vision. Simply carrying a light and waving it from side to side will not allow for effective ocular adjustment and thus the acuity is weak to non-functional, especially in the dark.

The flicker fusion rate is a concept in the psychophysics of vision. It is defined as the frequency at which an intermittent light stimulus appears to be completely steady to the observer. Flicker fusion threshold is related to persistence of vision. In essence, light stimulus can appear steady to an observer depending upon the frequency of light modulation. Humans typically cannot "see" flicker above a particular hertz rate and thus an object will appear to be immobile when illuminated through a high flicker rate. Here, we would refer to a path a hiker is traveling on at night.

Traditional flashlights produce a targeted beam of static light which will widen or narrow in intensity based upon the distance to target. This does not relate well to flicker fusion rates because the eye will see only that illuminated by primarily the central and fixed beam of light. As one moves the beam vertically or horizontally, the movement must be slow in order to allow the neural signals to, in effect, catch up with the rate of illumination. This is not effective when a person is in motion, especially in low light conditions. Thus, a standard flashlight is not an effective mode of illumination for a hiker on a dimly lit or dark path.

Since flicker or light modulation can be sensed greater in peripheral vision than in foveal or center vision, the headlamp provides optimum partnering between the two forms of vision. Thus, when a hiker moves his or her head, the headlamp beam moves in tandem and provides sufficient light for viewing yet dim enough to allow foveal adjustment. The headlamp functions quickly enough to also be used by cyclists in low light or dark.

Power consumption is also optimized. Through pulsation, which requires less power than a fixed beam of light, batteries are conserved. LED lights may also aid in power conservation requiring as little as 2 watts as contrasted with incandescent or florescent bulbs which can require 30 watts or more.

The headlamp is powered by rechargeable batteries which may be charged via connection to a vehicle outlet for convenience when away from a dwelling, or by a simple AC source such as a wall outlet. An embodiment also includes a detachable handle wherein the headlamp may be converted to a hand-help lamp.

BRIEF DESCRIPTION OF THE DRAWINGS

The invention is described in further detail by reference to six drawings sufficient in detail to describe the invention in which.

DETAILED DESCRIPTION, INCLUDING BEST MODES OF CARRYING OUT THE INVENTION

Figure 1:
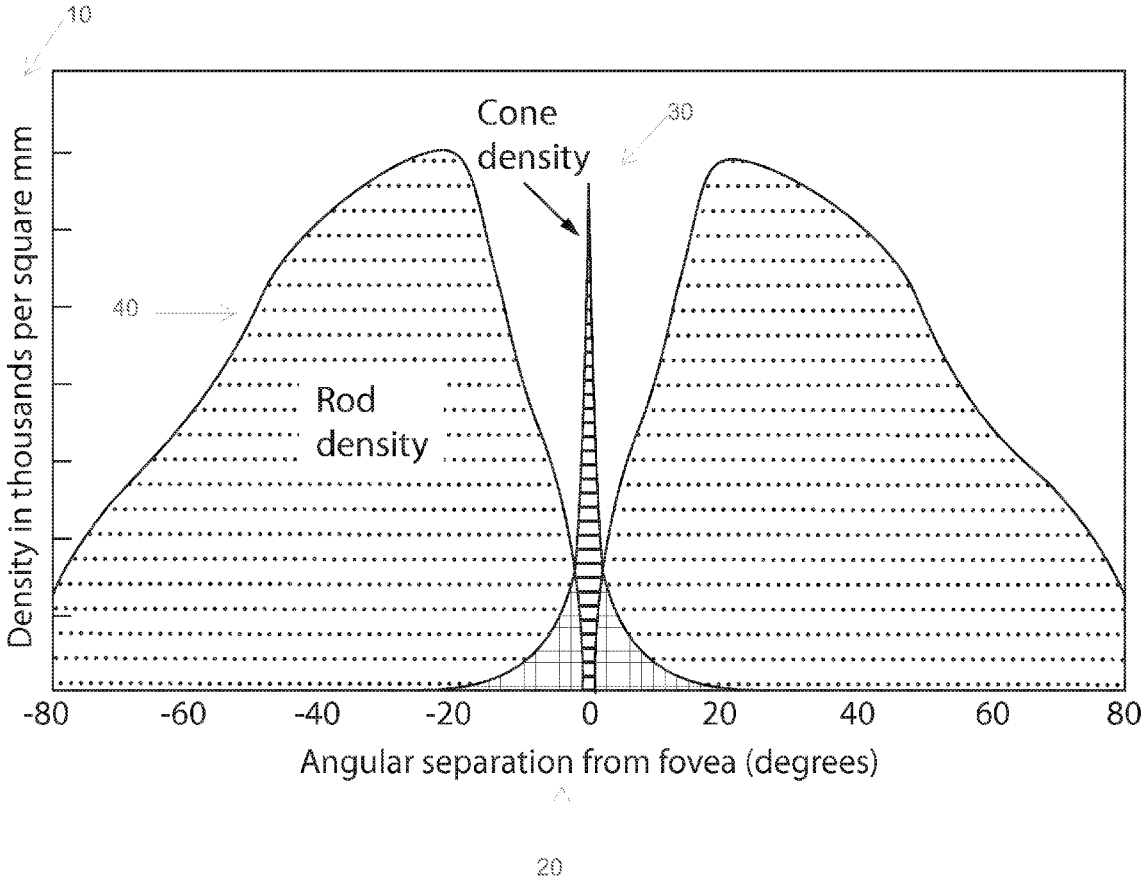
FIG. 1 is a graph illustrating density curves for rod and cone acuity.

FIG. 1 is a graph which illustrates density curves for the rods and cones of the human eye. On the y axis 10 is density in thousands per square mm. On the x axis is angular separation in degrees from fovea or center vision 20. The Measured density curves for the rods and cones on the retina show an enormous density of cones in the fovea 30. To them is attributed both color vision and the highest visual acuity. The rods 40 are responsible for night vision, our most sensitive motion detection, and our peripheral vision.

Figure 2:
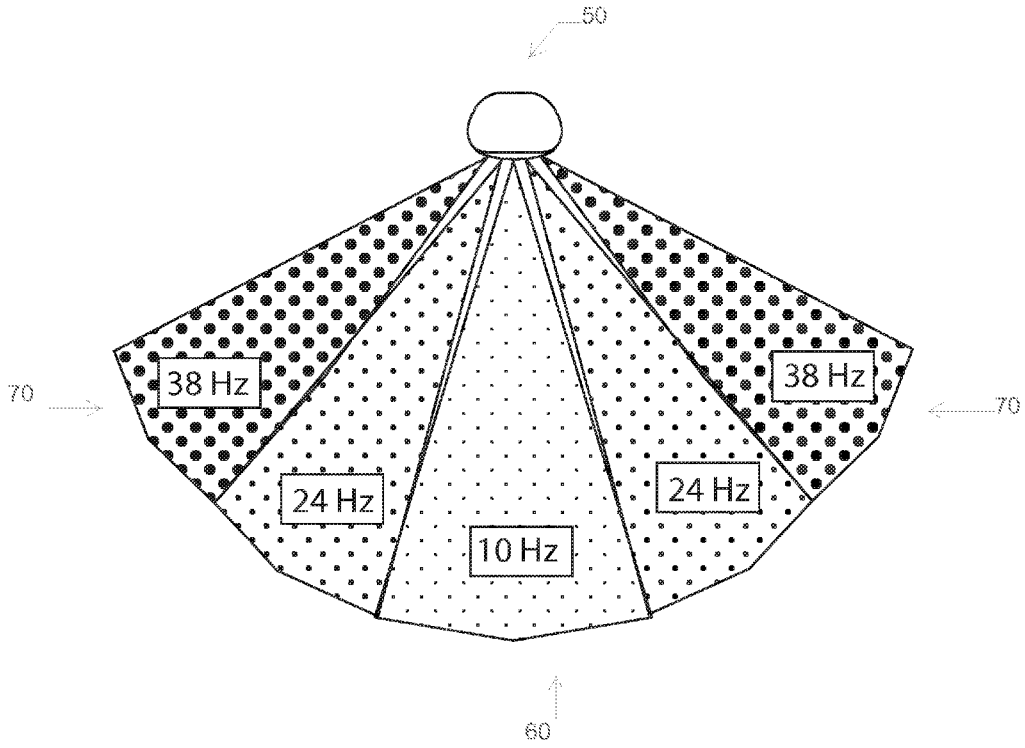
FIG. 2 is a graphic that shows the bandwidth of varying light beam levels.

FIG. 2 represents the bandwidth and variation of light as will correspond to the rod and cone configuration of the human eye as explained by FIG. 1. From the center of the headlamp 50, lights in varying hertz levels will span out from the center 60 beginning at 10 hz for low frequency and foveal adjustment optimization. At the periphery 70 the light is at 38 hz to optimize flicker fusion rate and sensitivity to movement for peripheral vision.

Figure 3:
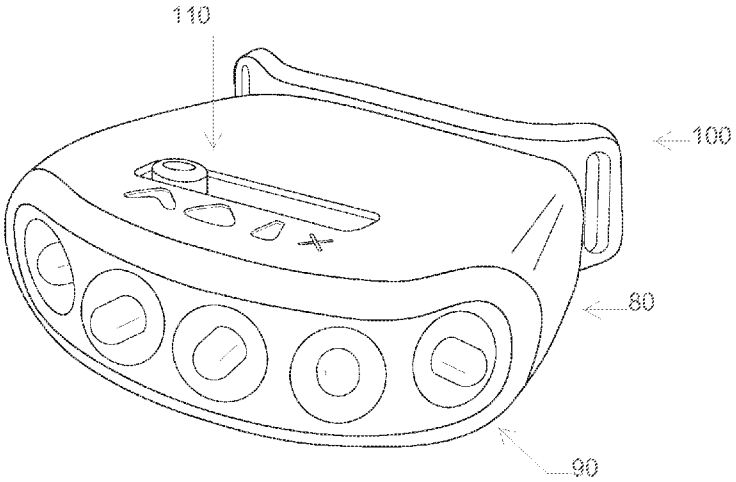
FIG. 3 is a side angle perspective view of the headlamp.

FIG. 3 is a design of the headlamp 80, in this instance, using 5 LED array 90 applying the varying hertz levels as in FIG. 2. A bracket for a head or helmet strap is also illustrated 100. Controls are located on top of the unit 110 and explained further in FIG. 4.

Figure 4:
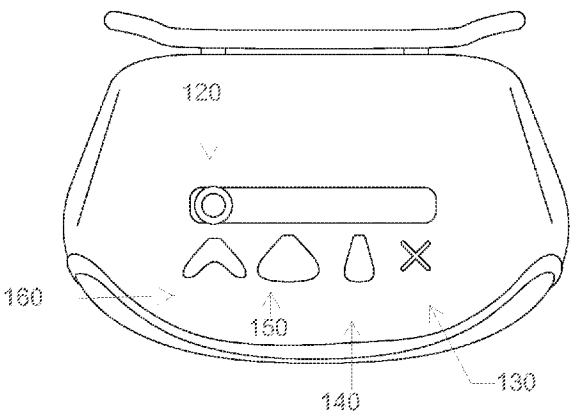
FIG. 4 is a top perspective view of the headlamp.

FIG. 4 is a top perspective of the headlamp showing a control set which may be customized and varied to a degree. In this embodiment, a slide toggle 120 allows selections. Options include an off button 130 signified here by an "x". Center beam control only 140 is another optional mode. Full power 150 may be selected which utilizes 100% of the LEDs power for maximum illumination as a work light. Finally, a pathfinder frequency fusion option selection 160 wherein the LEDs on the peripheral are brighter with higher flicker rate, and the center LEDs are lower with lower flicker rate.

Figure 5:
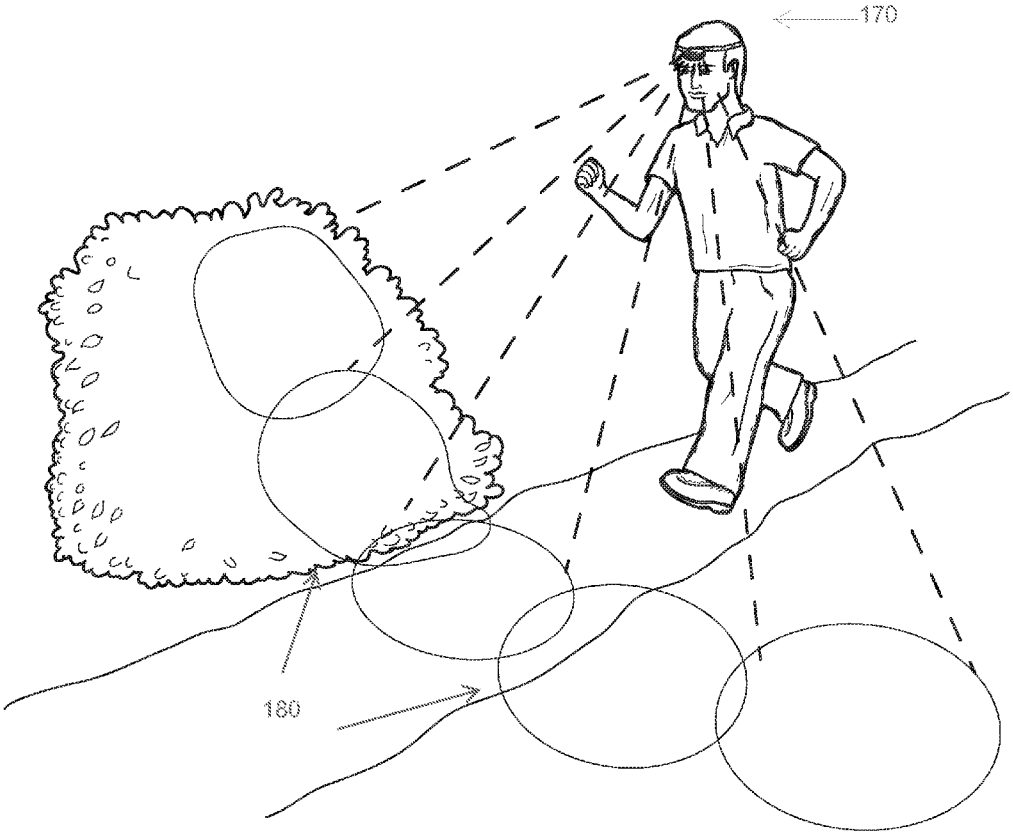
FIG. 5 is a representation of a hiker wearing the headlamp and associated illumination.

FIG. 5 is a simple rendition of a person utilizing the inventive headlamp 170. The corresponding beams to the varying hertz rate LED's are illustrated in basic phase 180 to indicate an approximate field of vision.

Figure 6:
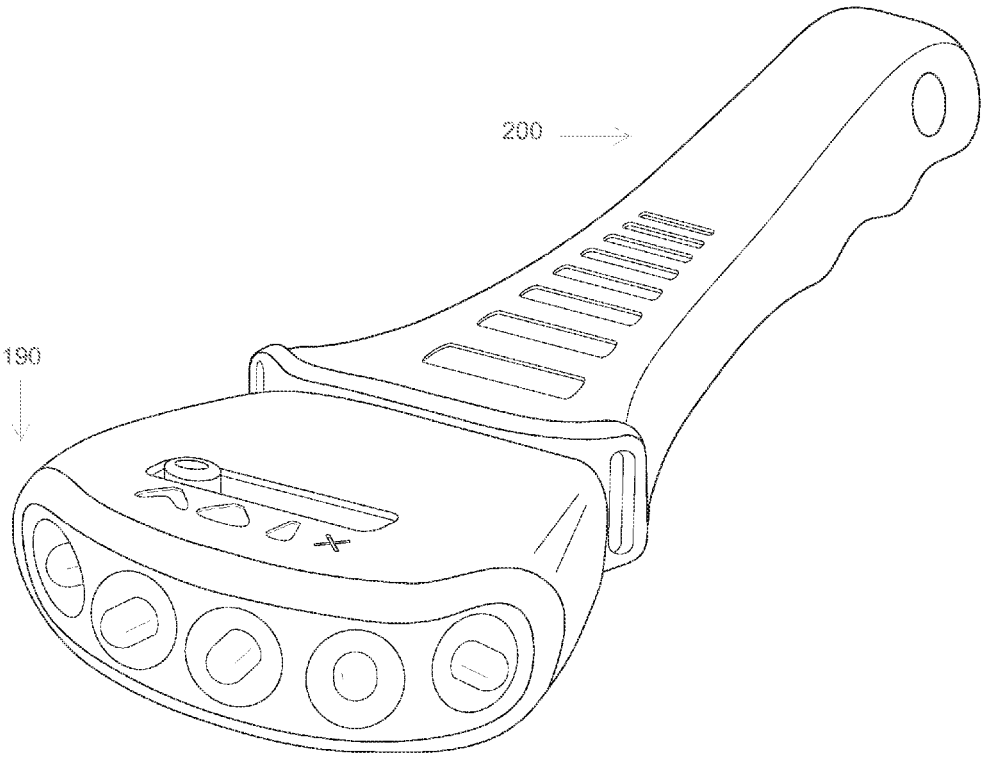
FIG. 6 is the headlamp with optional handle.

FIG. 6 is a view of the headlamp 190 as affixed to a detachable handle 200 wherein a user can operate as a hand-held lamp when not requiring hands-free operation. The lamp's controls function the same in either configuration.

The invention claimed is:

1. A light modulating recreational headlamp comprising;

a) LED light array comprising at least 5 lights with hertz variations from 10 mhz to 38 mhz b) multi-function control panel c) dual use head strap mounting mechanism d) power source e) detachable handle.

2. A headlamp as in claim 1 wherein the control panel is located on the lamp housing and offers multiple options for light and power control.

3. A headlamp as in claim 1 wherein an elastic or plastic strap can be looped through apertures on the headlamp and affixed to a head or a climbing helmet.

4. A headlamp as in claim 1 wherein said power source can be a cable for connection to a vehicle auxiliary outlet or a standard AC outlet.

5. A headlamp as in claim 1 wherein a detachable handle can be connected to convert the headlamp into a hand-help lamp and wherein the hand held lamp will utilize the controls.

* * * * *